US009285115B2

(12) United States Patent
Gasparini

(10) Patent No.: US 9,285,115 B2
(45) **Date of Patent: *Mar. 15, 2016**

(54) COOKING TOP

(75) Inventor: Alberto Gasparini, Fabriano (IT)

(73) Assignee: INDESIT COMPANY S.P.A., Fabriano (IT)

( * ) Notice: Subject to any disclaimer, the term of this patent is extended or adjusted under 35 U.S.C. 154(b) by 697 days.

This patent is subject to a terminal disclaimer.

(21) Appl. No.: 12/528,640

(22) PCT Filed: Oct. 29, 2007

(86) PCT No.: PCT/IB2007/003328

§ 371 (c)(1),
(2), (4) Date: Aug. 26, 2009

(87) PCT Pub. No.: WO2008/104831

PCT Pub. Date: Sep. 4, 2008

(65) Prior Publication Data

US 2010/0101557 A1 Apr. 29, 2010

(30) Foreign Application Priority Data

Feb. 27, 2007 (IT) ..... RN2007A0012

(51) Int. Cl.

| | |
|---|---|
| ***F24C 3/00*** | (2006.01) |
| ***F24C 15/10*** | (2006.01) |
| ***F23D 14/12*** | (2006.01) |
| ***F23D 14/06*** | (2006.01) |
| ***F24C 3/08*** | (2006.01) |

(Continued)

(52) U.S. Cl.

CPC ..... *F23D 14/065* (2013.01); *F23D 14/085* (2013.01); *F23L 9/02* (2013.01); *F24C 3/00* (2013.01); *F24C 3/08* (2013.01); *F24C 3/085* (2013.01); *F23D 2900/14062* (2013.01); *F23D 2900/14063* (2013.01)

(58) Field of Classification Search

CPC ..... F23C 9/00; F24C 3/00; F24C 3/08; F24C 3/085; F23D 14/065; F23D 2900/14062; F23L 9/02

USPC ..... 126/39 E, 39 J; 431/328

See application file for complete search history.

(56) References Cited

U.S. PATENT DOCUMENTS 2,220,247 A * 11/1940 Kochendorfer et al. ..... 431/349
2,781,779 A * 2/1957 Kindl ..... 137/601.16

(Continued)

FOREIGN PATENT DOCUMENTS

| | | |
|---|---|---|
| AU | 412372 B2 | 4/1971 |
| BE | 547098 | 12/1959 |

(Continued)

*Primary Examiner* — William G Corboy

(74) *Attorney, Agent, or Firm* — Cesari and McKenna, LLP

(57) ABSTRACT

A cooking top, especially for household use, comprises an upward facing top cover and at least one first gas burner, the first gas burner in turn comprising: first flame divider means which puts the first burner in operative communication with the outside of the cover and comprises first flame outlets in turn comprising outlet sections facing at least partly upwards, said outlet sections defining a first crown and said first crown defining and at least partly surrounding a first portion of the cooking top; and a secondary air feed conduit which extends at least partially inside the cooking top between an inlet section and a discharge section through which the secondary air escapes to the outside environment, the discharge section being formed in the first portion.

11 Claims, 9 Drawing Sheets

(51) Int. Cl.
*F23D 14/08* (2006.01)
*F23L 9/02* (2006.01)

(56) References Cited

U.S. PATENT DOCUMENTS

| | | | | | |
|---|---|---|---|---|---|
| 3,830,216 | A | * | 8/1974 | Dodd | 126/39 J |
| 3,858,811 | A | | 1/1975 | Mizerak et al. | |
| 5,152,276 | A | * | 10/1992 | Brock et al. | 126/39 E |
| 5,623,917 | A | * | 4/1997 | Dinaso et al. | 126/39 H |
| 6,209,534 | B1 | * | 4/2001 | Taplan | 126/39 R |
| 6,263,868 | B1 | | 7/2001 | Koch et al. | |
| 6,332,460 | B1 | * | 12/2001 | Paesani | 126/39 R |
| 6,508,245 | B2 | * | 1/2003 | Taplan | 126/39 R |
| 6,537,065 | B1 | * | 3/2003 | Shirali et al. | 431/354 |
| 7,001,176 | B2 | * | 2/2006 | Bettinzoli | 431/354 |
| 2005/0277079 | A1 | | 12/2005 | Wu | |

FOREIGN PATENT DOCUMENTS

| | | | | | |
|---|---|---|---|---|---|
| DE | 392522 | | 3/1924 | | |
| DE | 3918722 | | 11/1990 | | |
| DE | 10315343 | A1 | 10/2004 | | |
| EP | 0485645 | | 5/1992 | | |
| EP | 0552135 | A | 7/1993 | | |
| EP | 1132685 | | 9/2001 | | |
| EP | 1531304 | A | 5/2005 | | |
| FR | 432193 | | 11/1911 | | |
| FR | 2404803 | | 4/1979 | | |
| FR | 2414681 | | 8/1979 | | |
| GB | 2223302 | | 4/1990 | | |
| GB | 2233444 | A | 1/1991 | | |
| GB | 2280743 | | 2/1995 | | |
| JP | 61 086507 | | 5/1986 | | |
| JP | 02089917 | A | * | 3/1990 | F24C 3/08 |
| WO | WO 93/18342 | | * | 9/1993 | F23D 14/16 |
| WO | WO 2005/078342 | | | 8/2005 | |
| WO | WO 2007/012766 | | | 2/2007 | |

* cited by examiner

COOKING TOP

RELATED APPLICATIONS

This application is the National Stage of International Application No. PCT/IB2007/003328 filed on Oct. 29, 2007, which claims the benefit of Italian Application No. RN2007A000012 filed on Feb. 27, 2007. The contents of both applications are hereby incorporated by reference in their entirety.

TECHNICAL FIELD

This invention relates to a cooking top, especially a cooking top suitable for household use and comprising at least one gas burner.

BACKGROUND ART

The market currently offers several different types of domestic cooking tops. One of the most widely used types of cooking top includes one or more gas burners where the heat necessary for cooking food is generated by the combustion of a gas suitably mixed with air.

On 30 Sep. 2005, the Applicant filed an application, numbered TOA2005A000685, for an Italian industrial invention patent. That patent application describes a cooking top especially designed for use in the home. The top comprises an upward facing top cover, usually referred to simply as "surface" by experts, in the trade. The cooking top also comprises a gas burner which in turn comprises flame divider means positioned near the top cover. The flame divider means put the first burner in operative communication with the outside of the top cover and comprise flame outlets in turn comprising upward facing outlet sections. The outlet sections of the flame outlets together define a flame crown and said flame crown delimits a first portion of the cooking top. Advantageously, the crown comprises a plurality of concentric sub-crowns, each sub-crown comprising a plurality of outlet sections of the flame outlet sections.

The cooking top of the type described above are not free of disadvantages.

In particular, the individual flames propagating from the outlets of the innermost sub-crowns have only a limited amount of secondary air. As a result, combustion is not optimal and unburnt fuel components such as CO e $NO_x$ are generated.

DISCLOSURE OF THE INVENTION

This invention therefore has for an aim to overcome the above mentioned disadvantages by providing a cooking top which improves gas combustion.

Another aim of the invention is to provide a cooking top which improves cooking uniformity.

These and other aims, which will become more apparent in the description which follows, are achieved in accordance with the invention by a cooking top having the structural and functional characteristics described in the appended independent claims, while other embodiments of the cooking top according to the invention are described in the dependent claims.

BRIEF DESCRIPTION OF THE DRAWINGS

The invention will now be described in more detail with reference to the accompanying drawings, which illustrate non-limiting preferred embodiments of it.

DETAILED DESCRIPTION OF THE PREFERRED EMBODIMENTS OF THE INVENTION

Figure 1:
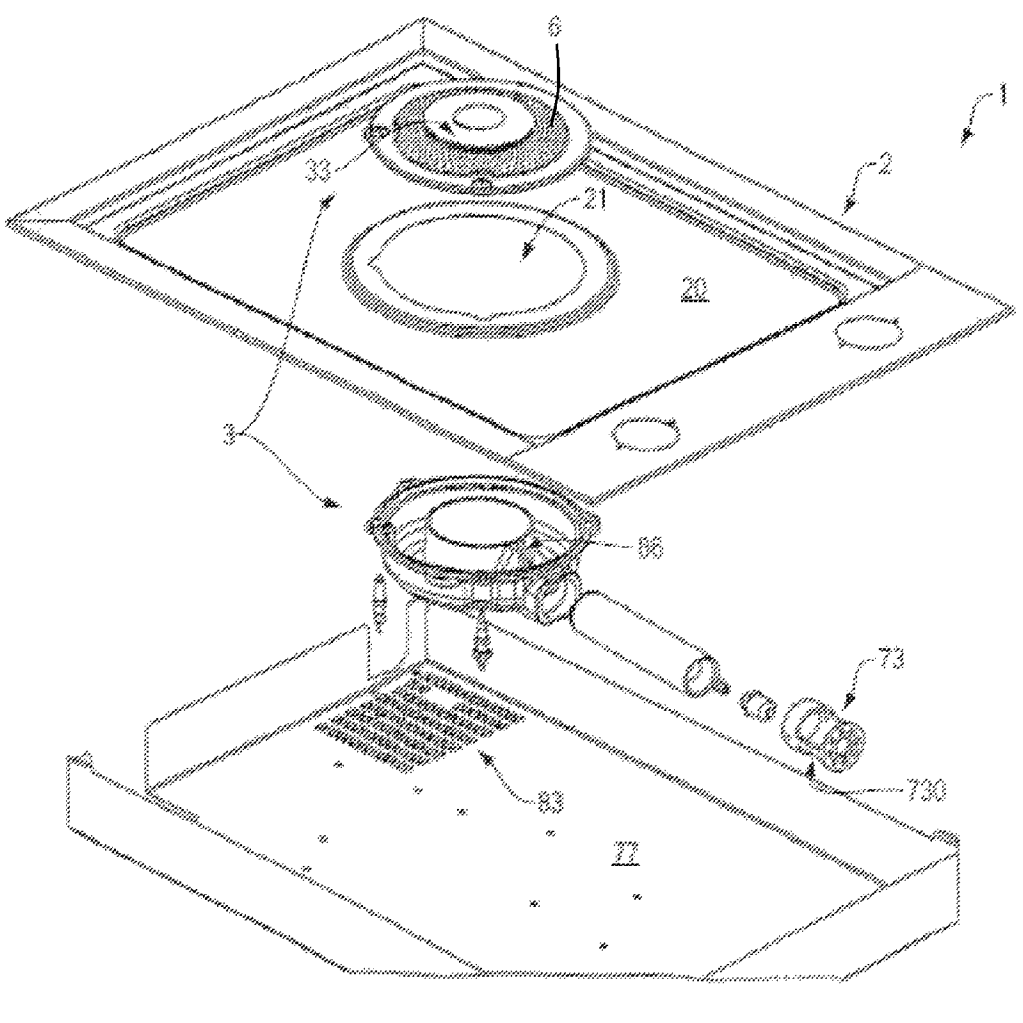
FIG. 1 is an exploded view of the cooking top according to this invention.

With reference to FIG. 1, the numeral 1 denotes a cooking top, in particular a cooking top suitable for household use. The cooking top 1 comprises an upward facing top cover 2 and at least one first gas burner 3. The top cover 2 is usually referred to simply as "surface" by experts in the trade.

The first gas burner 3 in turn comprises first flame divider means 310. The first flame divider means 310 put the first burner 3 in operative communication with the outside of the top cover 2 and comprise first flame outlets 34 in turn comprising outlet sections that face upwards at least partly. Advantageously, the first flame divider means 310 are located close to the top cover 2, and in some cases are mounted against the top cover 2.

The individual flames enabling the food to be cooked are generated outside the outlet sections of the first flame outlets 34.

The outlet sections of the first flame outlets 34 together define a first crown 32. The first crown 32 delimits and at least partially surrounds a first portion 33 of the cooking top 1. The top cover 2 comprises a first surface 20, normally visible, in turn comprising a hole 21 for accommodating the first flame divider means 310. Usually, the first surface 20 of the top cover 2 is substantially flat.

The upward orientation of the outlet sections of the first flame outlets 34 generate a flame with a higher combustion efficiency (approximately 10% higher) than flames generated by flame holes with vertical outlet sections (where the axis passing through the geometric centre of gravity of the outlet section at right angles to the latter is horizontal). Combustion efficiency means the ratio between the heat transferred to the cooking pan over the flame and the quantity of heat made available by the burner.

The first flame divider means 310 are advantageously situated at almost the same level as the top cover 2 of the cooking top 1. Thus, the means that support the cooking pans may be lower down relative to the top cover 2 of the cooking top 1. First flame divider means 310 that are lower down than in traditional burners where the flame holes have vertical outlet sections is, moreover, perfectly in line with current designer trends in favour of simple geometrical figures defined by essential and unobtrusive forms.

The first gas burner 3 in turn comprises a conduit 36 for feeding secondary air. The conduit 36 extends at least partially inside the cooking top 1. In particular, the feed conduit 36 is hidden from view by the first gas burner 3 and/or by the top cover 2. The feed conduit 36 extends between an inlet section and a discharge section 362 through which the secondary air escapes to the outside environment. The discharge section 362 is formed in the first portion 33. The feed conduit 36 thus provides the first portion 33 with a supply of secondary air independently of the barrier or obstacle created by the individual flames propagating from the first flame divider means 310.

In this text, the term "primary air" means the air mixed with the fuel gas inside the gas burner, while the term "secondary air" means the air added to the air-gas mixture already formed in the area outside the cooking top 1 in order to optimize combustion by providing an additional supply of oxygen.

Figure 11:
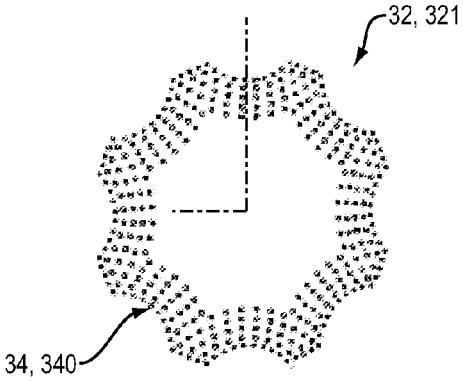
FIGS. 11 to 14 show alternative embodiments of a component of the cooking top according to the invention.
Figure 12:
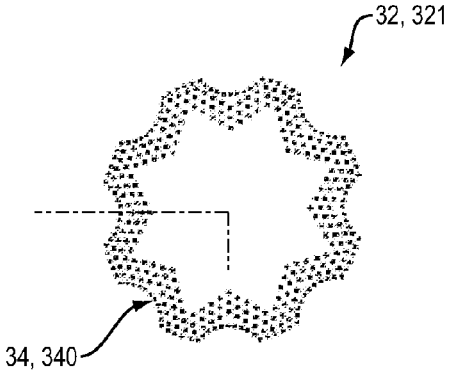

The first crown 32 may have a discoidal, polygonal or curvilinear shape, a mixed polygonal and curvilinear shape or any other geometric shape. Further, the first crown 32 may extend along a closed, unbroken line or along a broken line (the latter solution not being illustrated). In the non-limiting example embodiment illustrated in FIGS. 11 and 12, the first crown 32 is star shaped.

Advantageously, but not necessarily, the first crown 32 has the shape of a closed ring.

Advantageously, the outlet sections of the first flame outlets 34 face upwards at an angle to the horizontal of between 0° and 30°, and preferably at an angle of approximately 15°.

Advantageously, the normals to the outlet sections passing through the geometric centres of gravity of the corresponding outlet sections make with the vertical an angle of between 0° and 30°, preferably an angle of 15°.

This creates a "carpet flame" configuration, that is to say, a flame that propagates outwards in a substantially vertical direction or inclined at a limited angle to the vertical. The direction of the individual flames propagating from the outlet sections of the first flame outlets 34 is oriented upwards.

The outlet sections of the first flame outlets 34 are formed entirely on a single part. The whole perimeter of the outlet sections of the first flame outlets 34 thus forms part of the single part.

In a first solution, the outlet sections of the first flame outlets 34 are substantially parallel to the top cover 2.

Alternatively, the outlet sections of the first flame outlets 34 are at least partly inclined at an angle to the top cover 2.

Advantageously, the first crown 32 comprises a dense distribution of outlet sections of the first outlets 34.

In the non-limiting example embodiment illustrated in FIGS. 1 to 4, the first crown 32 is delimited by an inner edge 320 and an outer edge 323. If the first crown 32 forms a closed loop, the inner edge 320 coincides with the inside perimeter of the first crown 32 and the outer edge 323 coincides with the outside perimeter of the first crown 32. Advantageously, the first crown 32 extends in width between the inner edge 320 and the outer edge 323.

The width of the first crown 32, measured along at least one line joining the inner edge 320 to the outer edge 323, is greater than the dimension measured along that line of a single outlet section of the first flame outlets 34.

Preferably, the distribution of the outlet sections of the first flame outlets 34 in the first crown 32 has a regular pattern. In particular, first flame outlets 34 distributed in the first crown 32 in as regular and uniform a manner as possible improves heat distribution on the bottom of a cooking pan placed over the first crown 32, thereby improving cooking uniformity of the food inside the pan.

Advantageously, but without limiting the scope of the invention, the density of the outlet sections of the first flame outlets 34 is between 1 and 10 outlet sections per $cm^2$. The outlet sections of the first flame outlets 34 must not be spaced too widely so as not to obstruct the propagation of the flame front when igniting. At the same time, however, they must not be spaced too closely so that the individual flames do not interfere with each other, allowing a sufficient supply of secondary air to reach the flames that are located half way between the inner edge 320 and the outer edge 323 of the first crown 32.

Figure 3:
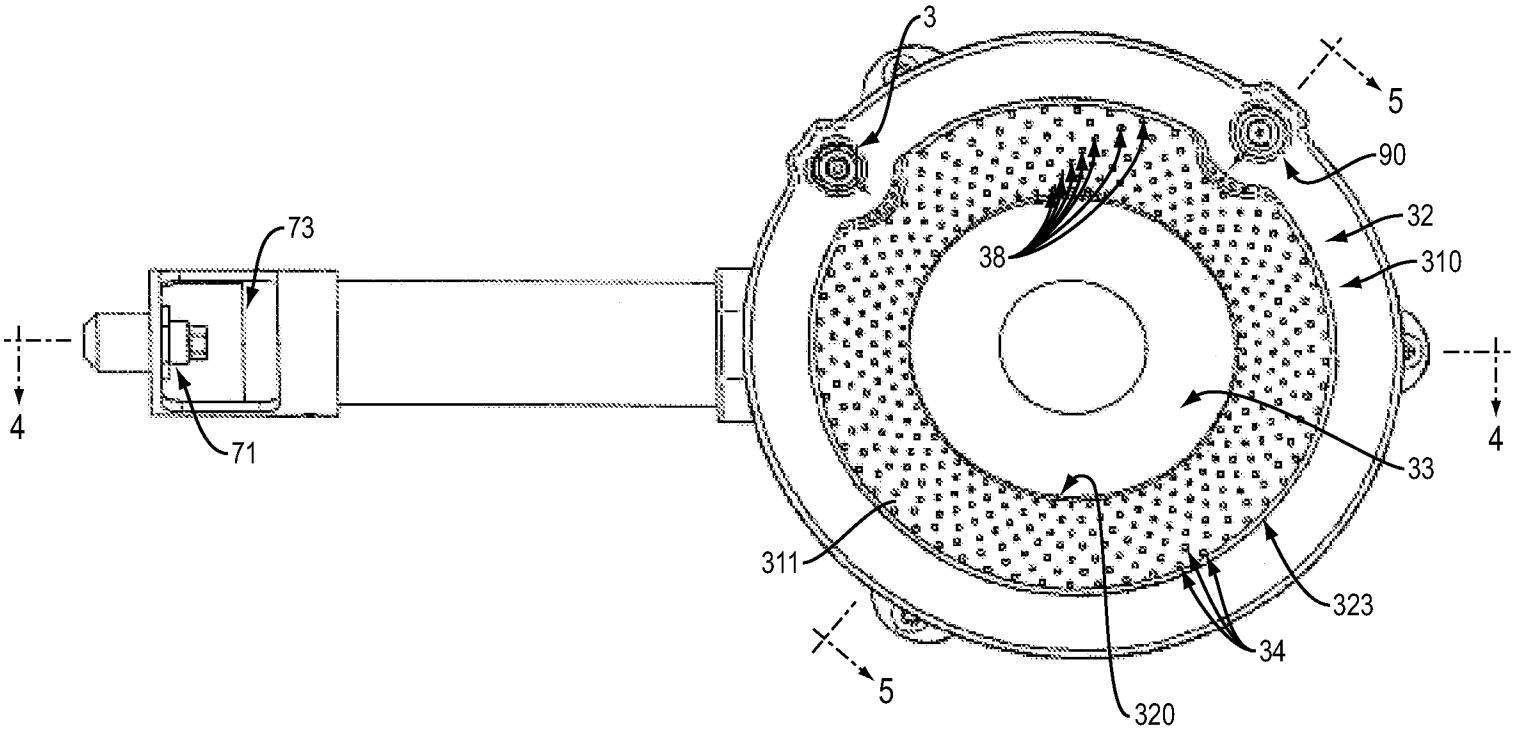
FIG. 3 is a plan view of a detail from FIG. 2.
Figure 4:
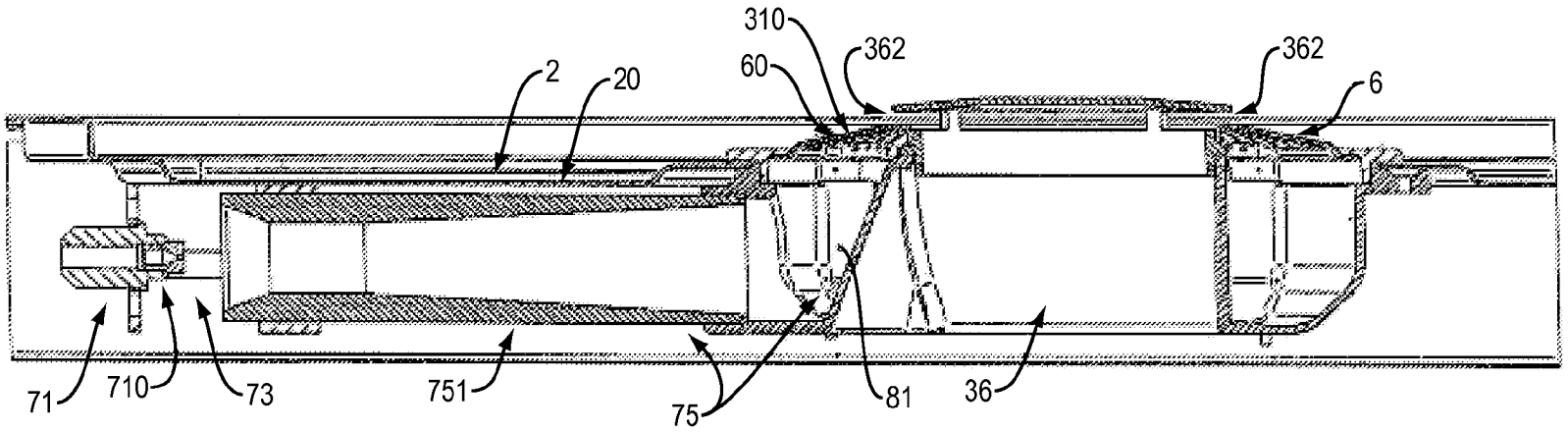
FIG. 4 shows a cross section through the plane A-A of FIG. 3.
Figure 5:
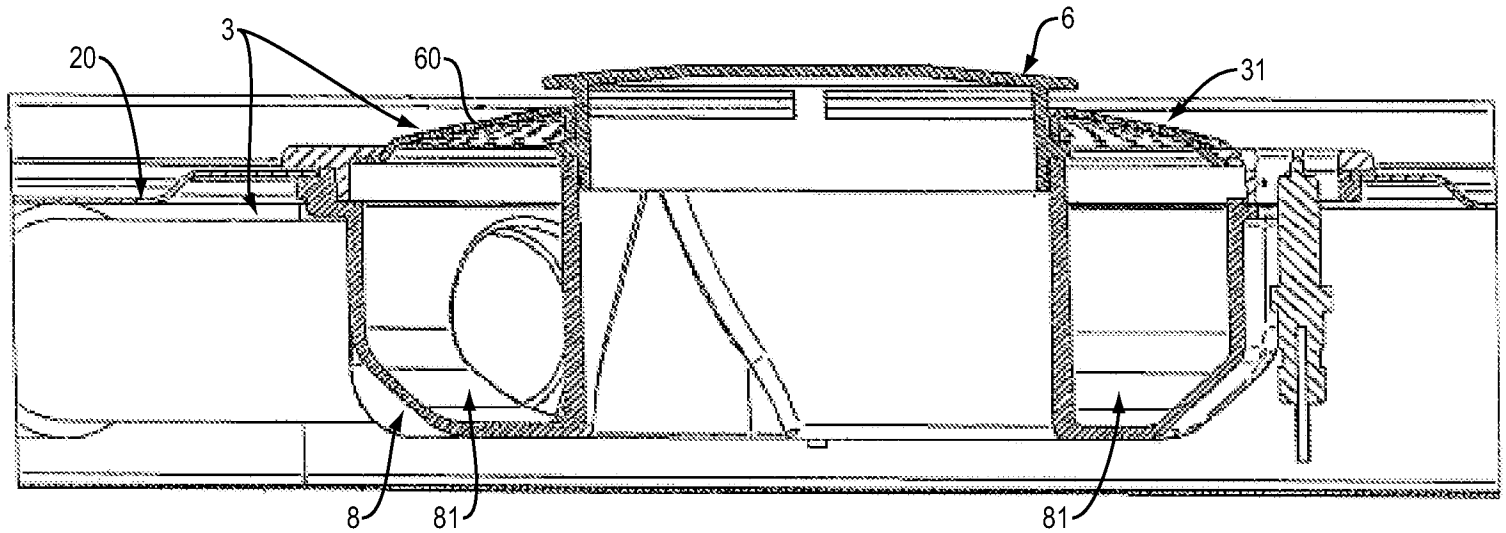
FIG. 5 shows a cross section through the plane B-B of FIG. 3.
Figure 6:
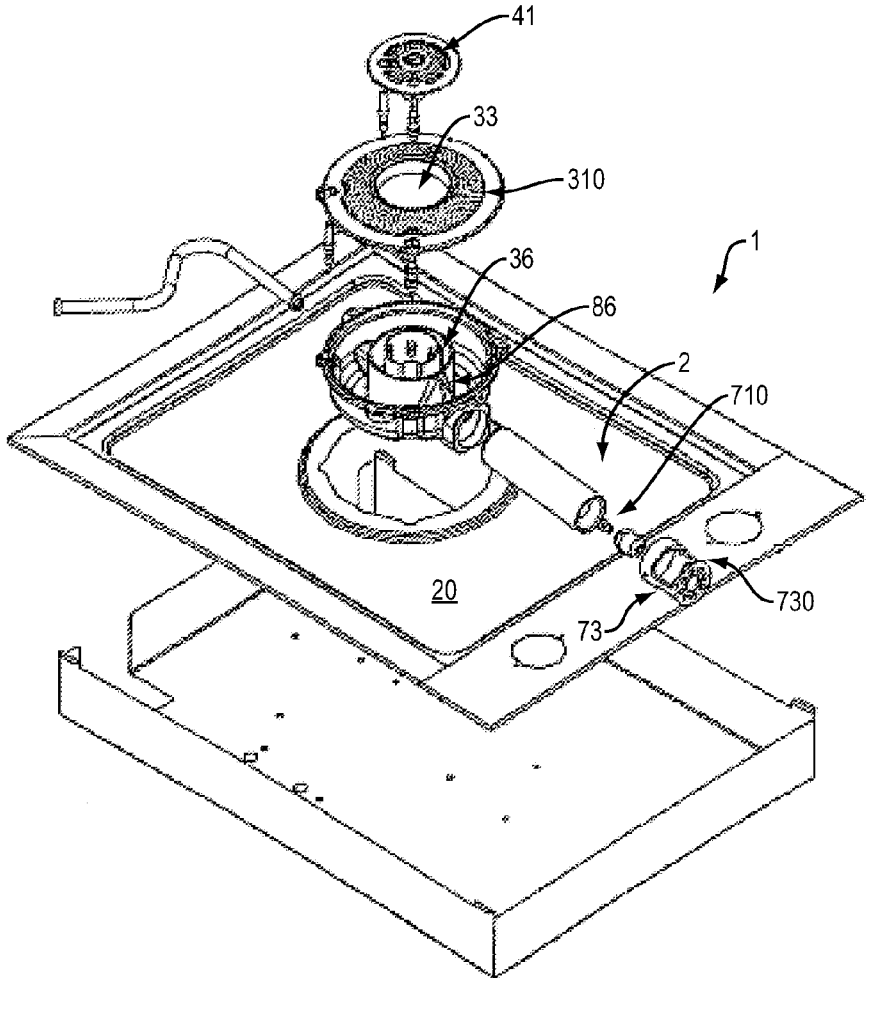
FIG. 6 is an exploded view of an alternative embodiment of the cooking top according to the invention.

As shown in the example of FIG. 3, the first crown 32 comprises a plurality of concentric sub-crowns 38. Each sub-crown 38 comprises a plurality of outlet sections of the first flame outlets 34. This increases the surface area heated directly by the flames.

Figure 2:
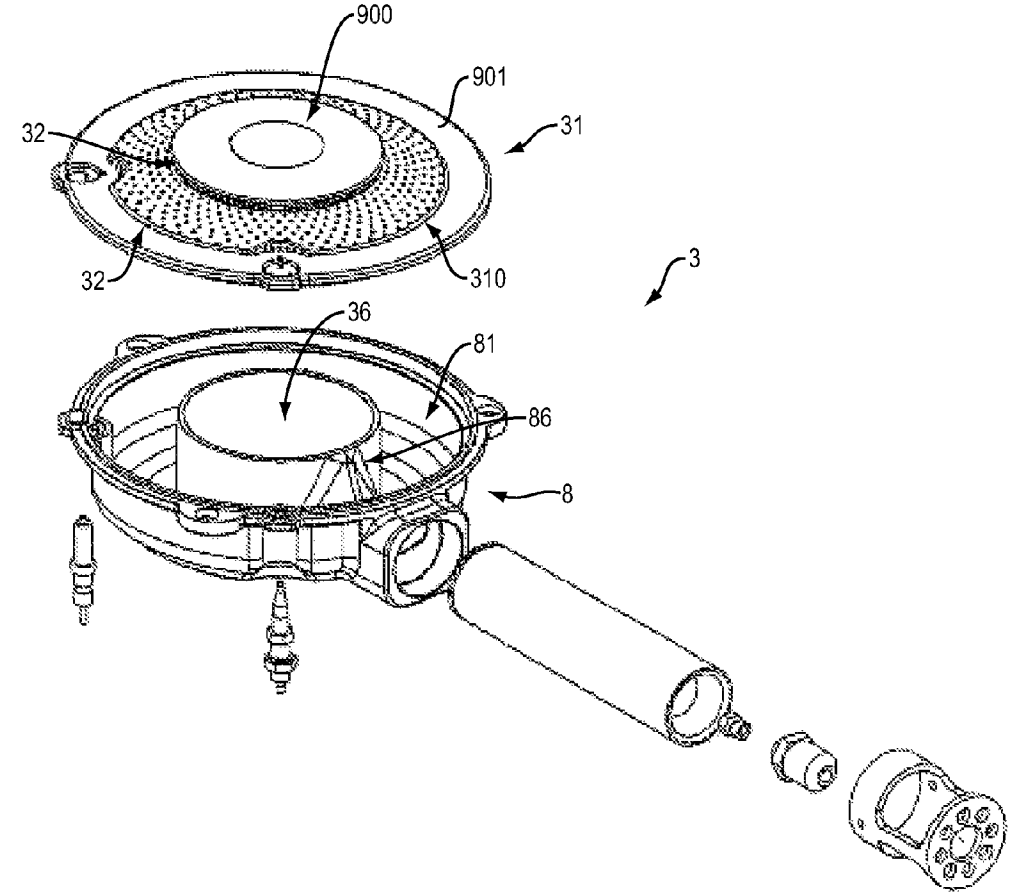
FIG. 2 is an exploded view of a detail from FIG. 1.

As illustrated by way of non-limiting example in FIG. 2, the outlet sections of the first flame outlets 34 of two adjacent sub-crowns 38 are offset from each other along the perimetric extension of the sub-crowns 38. More specifically, the first crown 32 comprises a plurality of sub-crowns 38 extending side by side along the width of the first crown 32. The number of sub-crowns 38 in the first crown 32 is such as to create an optimum compromise between the need to guarantee an adequate supply of secondary air to all the sub-crowns 38 and the aim of heating the bottom of a pan placed over the first gas burner 3 as uniformly as possible.

Figure 13:
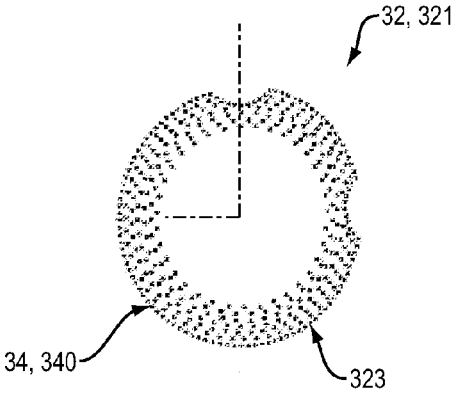
Figure 14:
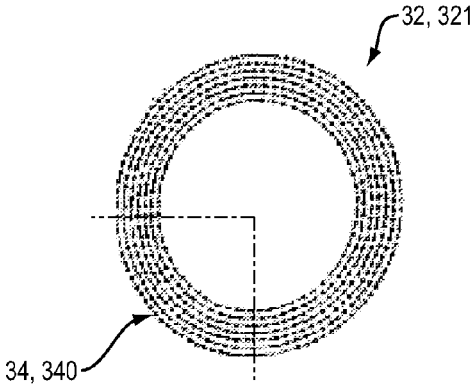

Advantageously, the outlet sections of the first flame outlets 34 are distributed more densely in the outer peripheral portion of the first crown 32. In particular, at least the sub-crown 38 at the outer edge 323 of the first crown 32 comprises a larger number of outlet sections than the sub-crowns 38 located nearer the inner edge 320 of the first crown 32 (as shown by way of non-limiting example in FIG. 13).

Advantageously, the first flame divider means 310 comprise a first sheet 311 comprising first flame holes. These first flame holes coincide with the first flame outlets 34. The first sheet 311 is made of steel, preferably stainless steel, or of any other suitable material, whether metallic, such as, for example, brass, inconel or aluminium, or non-metallic, such as, for example, a ceramic material. The thickness of the first sheet 311 depends on the type of material used and on the diameter of the first flame holes made in the first sheet 311. In the preferred case where the diameter of the first flame holes is between 0.7 mm and 2 mm, the first sheet 311 is preferably between 0.7 mm and 1.2 mm thick, this being a good compromise between the mechanical strength required of the first sheet 311 and the load losses that occur in the air-gas mixture as it flows through the first sheet 311. Alternatively, the first flame divider means 310 comprise a first fibrous membrane made from metal, metal alloy or ceramic fibres or a first porous membrane made from a ceramic, composite or metal material. Patent literature discloses numerous examples of such membranes made from metallic fibres: for example, but without limiting the scope of the invention, the membranes described in patent applications WO94/14608, WO95/27871 and WO02/99173 may be considered suitable for the cooking top 1 according to this invention.

The discharge section 362 of the secondary air feed conduit 36 extends along the inner edge 320 of the first crown 32. Advantageously, the inner edge 320 of the first crown 32 delimits the first portion 33. This guarantees a correct supply of secondary air also to the flames propagating from the sub-crowns 38 at the inner edge 320 of the first crown 32: in the embodiments illustrated in the accompanying drawings, these are the flames propagated from the radially innermost points of the first crown 32.

The bottom portion of the cooking top 1 comprises a cavity that communicates with the outside environment through a plurality of openings 83. The secondary air feed conduit 36 communicates with this cavity. The openings 83 are made in a bottom cover 77 of the cooking top 1, this bottom cover 77 being usually referred to as "box" by experts in the trade. Alternatively, if the bottom cover 77 is sealed, the cavity is in fluid communication with the outside environment through a plurality of openings made in the top cover 2 of the cooking top 1 (for example, at a control tap of the first burner 3, this solution not being illustrated).

The cooking top 1 comprises a relief portion 6 that rises above the top cover 2. Advantageously, the first flame divider means 310 of the first burner 3 extend on the slope 60 of the relief portion 6.

The slope 60 of the relief portion 6 is inclined at an angle to the horizontal plane of between 0° and 30°. Thus, the outlet sections of the first flame outlets 34 located at the inner edge 320 of the first crown 32 of the at least one first gas burner 3 are positioned higher up than the outlet sections of the first flame outlets 34 located at the outer edge 323. In the embodiment illustrated in the accompanying drawings, this feature improves the supply of secondary air to the radially innermost flames, independently of the presence of the feed conduit 36.

Advantageously, the relief portion 6 is a truncated cone.

The first flame divider means 310 are made on a first head 31 of the first burner 3, the first head 31 blending in with the top cover 2. This makes cleaning the top cover 2 and the first flame divider means 310 easier and quicker. Advantageously, the first head 31 comprises the first flame divider means 310, a central element 900 made in the first portion 33 and a connecting ring 901 between the top cover 2 and the perforated sheet 311. Both the top cover 2 and the first flame divider means 310 can easily be dirtied by contact with food and fatty substances during cooking. The smooth, blended connection between the top cover 2 and the first flame divider means 310 enables the user to wipe the cooking top 1 clean with a cloth quickly and easily. There are no difficult to clean corners or narrow gaps.

Moreover, to clean the cooking top 1, there is no need to remove external components or, at most, only a very limited number of components have to be removed, thus saving users a considerable amount of time and significantly increasing the effectiveness of cleaning operations. Thus, the first head 31 forms a single part that can be easily removed and replaced for cleaning (for example to remove stubborn dirt in a dishwasher or specific machine for re-opening clogged up holes).

The cooking top 1 may also comprise pan supporting means, said supporting means being designed to keep the pan containing the food to be cooked at a suitable distance from the top cover 2 of the cooking top 1. The cooking top 1 further comprises interface means designed to enable the operating parameters of each burner to be displayed and adjusted. These interface means may be of different types: for example, they may comprise an electronic interface of the "touch control" type or a mechanical interface with control taps.

The at least one first gas burner 3 comprises first means 71 for feeding the fuel gas and first means 73 for feeding the primary air into the first gas burner 3. The first fuel gas feed means 71 comprise a first gas feed nozzle 710; and the first primary air feed means 73 comprise air inlets 730 through which the primary air can flow in. The gas flowing out of the first nozzle 710 at high speed sucks the primary air into the first burner 3 through the first air inlets 730.

For ensuring the largest possible intake of primary air into the first gas burner 3 so as to minimize the secondary air requirement for combustion to take place with a correct stoichiometric ratio, the first air inlets 730 are large enough to allow the primary air to flow through them at an adequate rate. If the air intake created by the outflow of gas through the first nozzle 710 is not sufficient, a primary air forced circulation system may be provided.

The primary air is sucked into the cavity in the bottom portion of the cooking top 1, this cavity being in fluid communication with the outside environment through the above mentioned openings.

Downstream of the first means 71, 73 for feeding the fuel gas and the primary air, first means 75 are advantageously provided for mixing the fuel gas with the primary air. These first mixing means 75 comprise a first Venturi tube 751 into which the mixture of primary air and fuel is drawn. The first Venturi tube 751 may be oriented along a horizontal or vertical plane.

The first Venturi tube 751, besides optimizing the mixture of primary air and gas prevents the negative pressure created by the first nozzle 710 from causing disturbances downstream (for example, backdraft).

To reduce system size and when low powered units are sufficient, the first mixing means 75 may comprise a first divergent tube instead of the first Venturi tube 751.

The first mixing means 75 of the first burner 3 comprise a first structure 8 defining a first chamber 81 where mixing of the gas and the primary air is completed. This first chamber 81 is advantageously located downstream of the first Venturi tube 751 or of the first divergent tube. To optimize distribution of the primary air and gas mixture in the first chamber 81, a flow baffle 86 is positioned at the outlet of the first Venturi tube 751 in such a way as to be struck directly by the flow discharged from the first Venturi tube 751. The flow baffle 86 preferably forms a single part with the first structure 8.

The first chamber 81 is substantially axisymmetric. The top part of the first chamber 81 is defined by the first flame divider means 310. The first flame divider means 310 are also substantially axisymmetric and coaxial with the first chamber 81.

At the first flame divider means 310, the cooking top 1 comprises an ignition plug 9 which creates an electric spark that ignites the mixture of air and fuel gas. At the first flame divider means 310, the cooking top 1 also comprises a temperature detector 90 which interrupts the gas supply when the temperature falls below a defined minimum value, as when combustion of the air and gas mixture is extinguished.

Advantageously, the first portion 33 accommodates second flame divider means 41 of a second burner 4. This increases the total power made available for cooking. The provision of the second burner 4 also improves the point-to-point cooking uniformity since the combined action of the first and second burners 3, 4 directly heats a larger area of the pan placed over them. The adjective "second" in the text below refers to the components of the second burner 4.

The second burner 4 comprises second flame divider means 41 made within the first portion 33 of the cooking top 1. The second flame divider means 41 put the second burner 4 in operative communication with the outside of the top cover 2. Further, since the second flame divider means 41 are located inside the first flame divider means 310, they use a space which would otherwise be unused as in the embodiment illustrated in FIGS. 1 to 5. The discharge section 362 of the secondary air feed conduit 36 is located between the first flame divider means 310 of the first burner 3 and the second flame divider means 41 of the second burner 4.

At the second flame divider means 41, the cooking top 1 comprises a second ignition plug 91 which creates an electric spark that ignites the mixture of air and fuel gas. At the second flame divider means 41, the cooking top 1 also comprises a temperature detector 92 which interrupts the gas supply when the temperature falls below a defined minimum value, as when combustion of the air and gas mixture is extinguished. In one particular embodiment, the first and the second ignition plugs 9 and 91 may coincide. Similarly, in one particular embodiment, the first and the second temperature detectors 90 and 92 may coincide.

The second gas burner 4 comprises second, means 72 for feeding the fuel gas, second means 74 for feeding the primary air and second mixing means 76.

The second fuel gas feed means 72 comprise a second gas feed nozzle 720; and the second primary air feed means 74 comprise air inlets 740 through which the primary air can flow into the second burner 4. The gas flowing out of the second nozzle 720 at high speed sucks the primary air into the second burner 4 through the second air inlets 740.

Downstream of the second means 72, 74 for feeding the fuel gas and the primary air, second means 76 are advantageously provided for mixing the fuel gas with the primary air. These second mixing means 76 comprise a second Venturi tube into which the mixture of primary air and fuel is drawn. The second Venturi tube may be oriented along a horizontal or vertical plane.

The second Venturi tube, besides optimizing the mixture of primary air and gas prevents the negative pressure created by the second nozzle 720 from causing disturbances downstream (for example, backdraft).

To reduce system size and when low powered units are sufficient, the second mixing means 76 may comprise a second divergent tube 762 instead of the second Venturi tube.

The second mixing means 76 comprise a second structure 80 defining a second chamber 82 where mixing of the gas and the primary air is completed. This second chamber 82 is advantageously located downstream of the second Venturi tube or of the second divergent tube 762. The second chamber 82 where mixing of the gas and the primary air is completed is advantageously surrounded by the first chamber 81 of the first burner 3. The first and the second chambers 81, 82 are independent and separate from each other.

Figure 10:
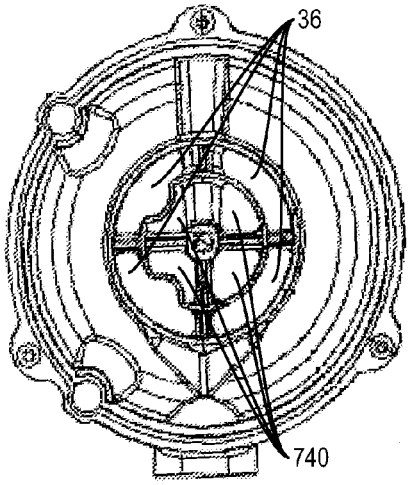
FIG. 10 is a top view of a component of the cooking top.

FIG. 10 shows a top view of the cooking top 1 with the second structure 80 cut away in order to better illustrate how the feed conduit 36 internally delimits the second air inlets 740.

Advantageously, the first and the second burners 3, 4 are fuelled independently of one another. The first and the second burners 3, 4 may be controlled independently of one another, thus requiring a pair of control taps, or they may be controlled using a single control tap.

The second means 72, 74 for feeding the fuel gas and the primary air are respectively independent of the first means 71, 73 for feeding the fuel gas and the primary air. Upstream of the first and second means 71, 72 for feeding the fuel gas, a single source of fuel gas is advantageously provided.

The second flame divider means 41 comprise second flame outlets 340. The second flame outlets 340 comprise outlet sections that face upwards at least partly.

The outlet sections of the second flame outlets 340 are formed entirely in the same surfaces of a single part. The whole perimeter of the outlet sections of the second flame outlets 340 forms part of that single part. The density and/or distribution of the outlet sections of the second flame outlets 340 are preferably similar to the density and/or distribution of the outlet sections of the first flame outlets 34.

Figure 7:
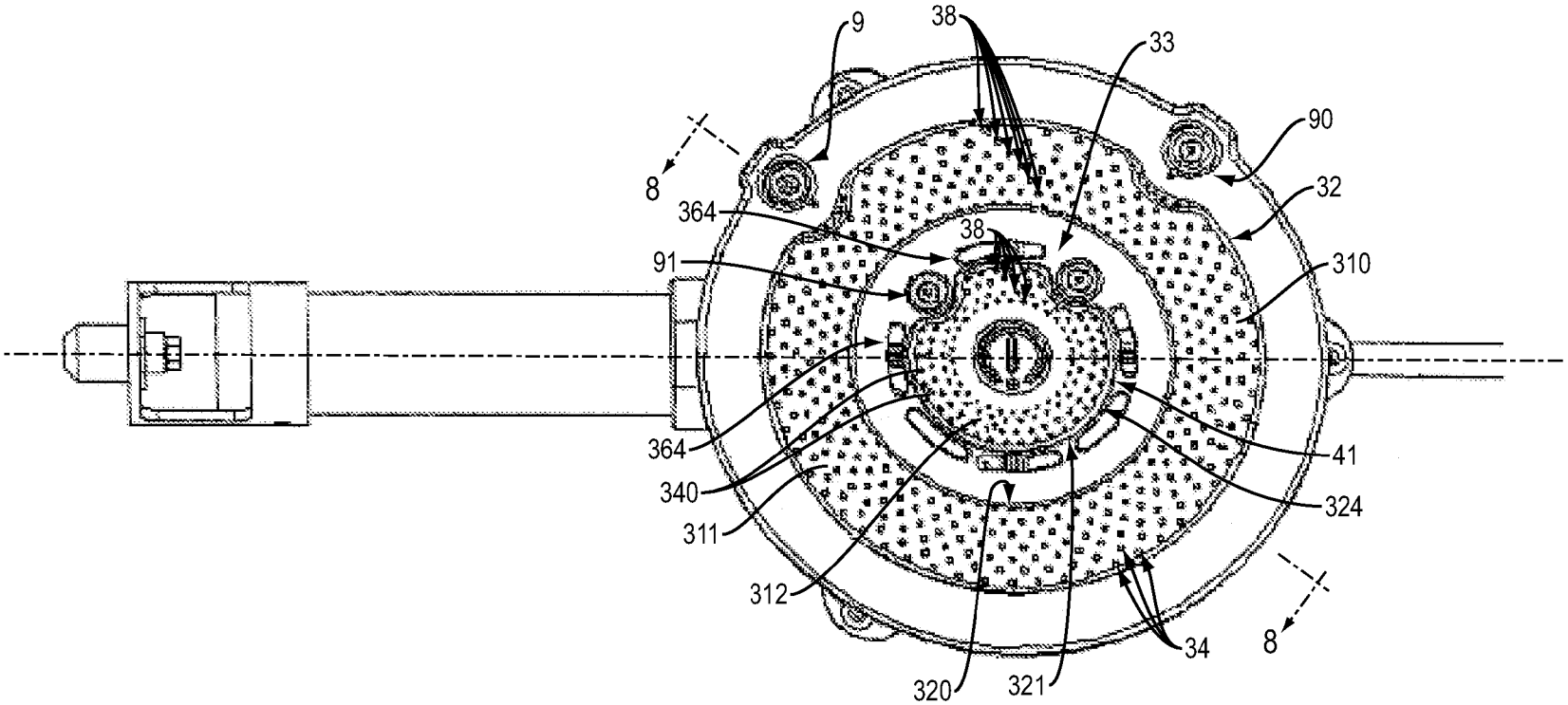
FIG. 7 is a plan view of a detail from FIG. 6.
Figure 8:
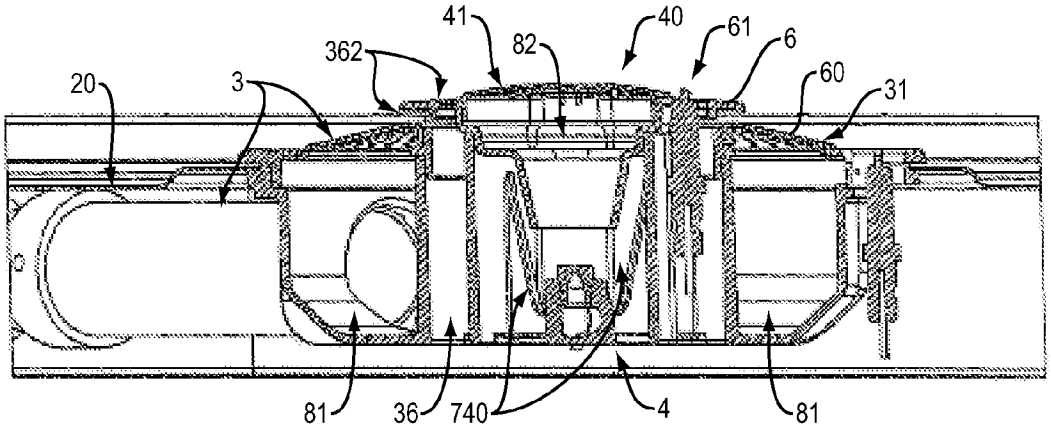
FIG. 8 shows a cross section through the plane D-D of FIG. 7.
Figure 9:
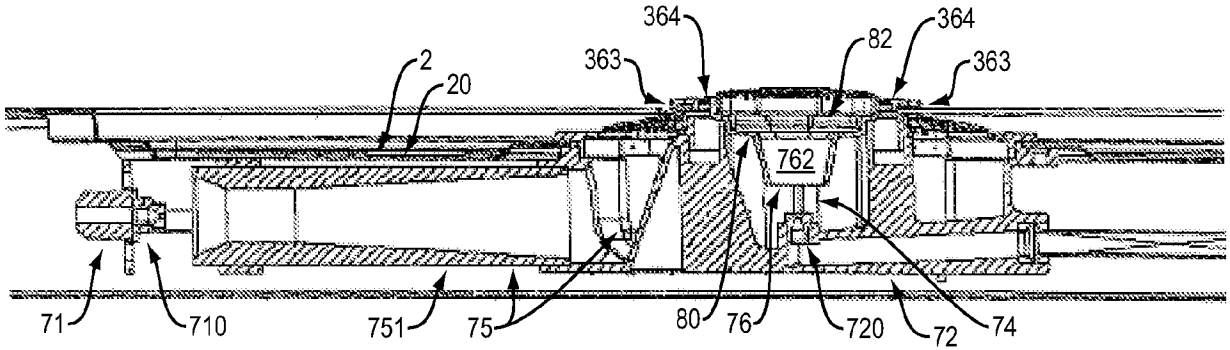
FIG. 9 shows a cross section through the plane C-C of FIG. 7.

Advantageously, the outlet sections of the second flame outlets 340 face upwards at an angle to the horizontal plane of between 0° and 30°. Preferably, the distribution of the outlet sections of the second flame outlets 340 in the second flame divider means 41 has a regular pattern. As shown by way of non-limiting example in FIG. 7, the outlet sections of the second flame outlets 340 together define a second crown 321. The second crown 321 comprises a plurality of concentric sub-crowns 38. Alternatively, the outlet sections of the second flame outlets 340 might define a full surface such as a circle, for example. The second flame divider means 41 comprise a second sheet 312. Alternatively, the second flame divider means 41 comprise a second fibrous membrane made from metal, metal alloy, ceramic or carbon fibres or a second porous membrane made from a ceramic, composite or metal material. Advantageously, the second flame divider means 41 are located at the top 61 of the relief portion 6 of the cooking top 1.

The discharge section 362 of the secondary air feed conduit 36 comprises a first part 363 that follows the inner edge 320 of the first crown 32 and a second part 364 that follows an outer edge 324 of the second crown 321.

Advantageously, the cooking top 1 may comprise a plurality of cooking points, normally variable in number between 2 and 6. The term "cooking point" means a defined area where food can be cooked. Normally, only one of the cooking points of the cooking top comprises both the first and the second burner 3 and 4. A cooking point of this kind is very powerful and specific for certain uses.

The invention brings important advantages.

First of all, it improves combustion of the air and gas mixture by permitting a better supply of secondary air.

Secondly, it allows the cooking top to be cleaned quickly and easily.

A no less important advantage is that it allows food to be cooked uniformly.

The invention can be modified and adapted in several ways without thereby departing from the scope of the inventive concept.

Moreover, all details of the invention may be substituted by other technically equivalent elements.

In practice, the embodiments of the invention may be made from any material, and in any size, depending on requirements.

The invention claimed is:

1. A cooking top, especially for household use, including an upward facing top cover and a gas burner, the gas burner in turn comprising:

first flame divider means which puts a first burner in operative communication with the outside of the top cover, the first flame divider means including first flame outlets that in turn include first outlet sections facing upwards, said first outlet sections together defining a first crown that defines and at least partly surrounds a first portion of the cooking top, wherein the first outlet sections extend on a slope of a relief portion, rising above the top cover, that is a truncated cone and inclined at a constant angle to a horizontal plane of between 0 degrees and 30 degrees, and wherein the first outlet sections of the first flame outlets located at an inner edge of the first crown are positioned higher up than the first outlet sections of the first flame outlets located at an outer edge of the first crown;

a secondary air feed conduit which extends at least partially inside the cooking top between an inlet section and a discharge section through which secondary air escapes to an outside environment, the discharge section being formed in the first portion and extending along the inner edge of the first crown, defined by the said first outlet sections extending on the slope of the relief portion, where the inner edge delimits the first portion; and a second flame divider means of a second burner in operative communication with the outside of the top cover, the second flame divider means within the first portion, wherein the second flame divider means includes second flame outlets that in turn include second outlet sections facing upward, said second outlet sections together defining a second crown and are in a constant angle to the horizontal plane of between 0 degrees and 30 degrees.

2. The cooking top according to claim 1, wherein the first crown has the shape of a closed ring.

3. The cooking top according to claim 1 wherein the distribution of the first outlet sections of the first flame outlets of the first crown follows a regular pattern.

4. The cooking top according to claim 1 wherein the first crown comprises a plurality of concentric sub-crowns.

5. The cooking top according to claim 4 wherein the first outlet sections of the first flame outlets of two adjacent sub-crowns are offset from each other along a perimetric extension of the sub-crowns.

6. The cooking top according to claim 1, wherein the first flame divider means comprises a first sheet including a plurality of first flame holes, said first flame holes coinciding with the first flame outlets.

7. The cooking top according to claim 1, wherein the first crown extends in width between the inner edge, which delimits the first portion, and an outer edge.

8. The cooking top according to claim 7, wherein the width of the first crown, measured along at least one line joining the inner edge to the outer edge, is greater than the dimension measured along that line of a single outlet section of the first flame outlets.

9. The cooking top according to claim 1, wherein the first portion accommodates the second flame divider means of the second burner, the discharge section of the secondary air feed conduit being located between the first flame divider means of the first burner and the second flame divider means of the second burner.

10. The cooking top according to claim 9, wherein the first and the second burners are fuelled independently of one another.

11. The cooking top according to claim 1 wherein the first flame divider means are made on a first head of the first burner, and the first head blends in with the top cover.

* * * * *